US010519074B2

(12) United States Patent
Reimer et al.

(10) Patent No.: US 10,519,074 B2
(45) Date of Patent: Dec. 31, 2019

(54) OBSCURANT EMISSION SYSTEMS AND METHODS

(71) Applicant: GOODRICH CORPORATION, Charlotte, NC (US)

(72) Inventors: Karl G. Reimer, Fairfield, CA (US); Jean C. Rodriguez, Vallejo, CA (US)

(73) Assignee: GOODRICH CORPORATION, Charlotte, NC (US)

( * ) Notice: Subject to any disclaimer, the term of this patent is extended or adjusted under 35 U.S.C. 154(b) by 165 days.

(21) Appl. No.: 15/271,076

(22) Filed: Sep. 20, 2016

(65) Prior Publication Data

US 2018/0079695 A1 Mar. 22, 2018

(51) Int. Cl.
*C06B 23/00* (2006.01)
*C06D 3/00* (2006.01)

(52) U.S. Cl.
CPC ..... *C06B 23/006* (2013.01); *C06B 23/00* (2013.01); *C06D 3/00* (2013.01)

(58) Field of Classification Search
CPC ..... C06B 23/00; C06B 23/006; C06D 3/00
See application file for complete search history.

(56) References Cited

U.S. PATENT DOCUMENTS

| | | | |
|---|---|---|---|
| 380,703 | A | 4/1888 | Snitzel |
| 3,607,472 | A | 9/1971 | Douda |
| 3,862,866 | A | 1/1975 | Timmerman et al. |
| 3,884,734 | A | 5/1975 | Palmer et al. |
| 4,032,374 | A | 6/1977 | Douda et al. |
| 4,968,365 | A | 11/1990 | Krone |
| 5,154,782 | A | 10/1992 | Shaw et al. |
| 5,522,320 | A | 6/1996 | Dillehay |
| 5,682,010 | A | 10/1997 | Embury |
| 6,558,487 | B1 | 5/2003 | Tadros |
| 8,182,711 | B2 | 5/2012 | Posson et al. |
| 9,034,126 | B2 | 5/2015 | Krone et al. |
| 2005/0242319 | A1 | 11/2005 | Posson |
| 2007/0163787 | A1 | 7/2007 | Posson et al. |
| 2010/0024686 | A1* | 2/2010 | Constantz ..... B01D 53/1425 106/817 |
| 2011/0155943 | A1* | 6/2011 | Posson ..... A62D 1/06 252/3 |
| 2012/0267016 | A1 | 10/2012 | Lombardi |
| 2013/0139935 | A1 | 6/2013 | Baggett, Jr. et al. |

(Continued)

FOREIGN PATENT DOCUMENTS

| | | |
|---|---|---|
| EP | 3219365 | 9/2017 |

OTHER PUBLICATIONS

Israeli Patent Office, Hebrew Office Action dated Jul. 30, 2018 in Application No. 253296.

(Continued)

*Primary Examiner* — Aileen B Felton
(74) *Attorney, Agent, or Firm* — Snell & Wilmer, L.L.P.

(57) ABSTRACT

An obscurant-emitting composition may comprise an oxidizer comprising a cation comprising at least one of an alkali metal or an alkaline earth metal, and an anion comprising at least one of nitrate, chlorate, bromate, iodate, perchlorate, periodate, or chlorite; a fuel; and a hydrated salt composition, wherein the obscurant-emitting composition comprises between 0.001% and 8% by weight hydrated salt composition.

7 Claims, 2 Drawing Sheets

(56) References Cited

U.S. PATENT DOCUMENTS

| | | | | |
|---|---|---|---|---|
| 2016/0107012 | A1 | 4/2016 | Reimer | |
| 2016/0115090 | A1* | 4/2016 | Moretti | C06D 3/00<br>102/334 |

OTHER PUBLICATIONS

European Patent Office, European Search Report dated Feb. 5, 2018 in Application No. 17192096.0-1105.
Selzer, Joel H., United States Statutory Invention Registration No. H232, Published Mar. 3, 1987.
Tracy, Gene V.., United States Statutory Invention Registration No. H233, Published Mar. 3, 1987.

* cited by examiner

OBSCURANT EMISSION SYSTEMS AND METHODS

FIELD

This disclosure relates to systems and methods for emitting obscurant from a combustible composition.

BACKGROUND

Obscurants are materials disseminated into the air to block or obscure the view of objects in an area by scattering, absorbing, or reflecting electromagnetic radiation. Obscurants may be designed to block or obstruct visible light, or other frequencies on the electromagnetic spectrum (e.g., infrared radiation). Traditionally, obscurant-emitting compositions, such as those comprising pyrotechnic compositions, exhibit undesirable properties such as high toxicity, high burn temperature which may cause undesired fire, inorganic residue build-up inhibiting emission of the obscurant, limited functional temperature range, low obscurant yield, humidity dependence, or a number of other shortcomings, making their use inefficient, or potentially hazardous to users.

SUMMARY

In various embodiments, an obscurant-emitting composition may comprise an oxidizer comprising a cation comprising at least one of an alkali metal or an alkaline earth metal, and an anion comprising at least one of nitrate, chlorate, bromate, iodate, perchlorate, periodate, or chlorite; a fuel; and a hydrated salt composition, wherein the obscurant-emitting composition comprises between 0.001% and 8% by weight hydrated salt composition. In various embodiments, the hydrated salt composition may comprise a primary compound and a secondary compound, wherein the primary compound comprises at least one of hydromagnesite, artinite, hydrotalcite, dypingite, giorgiosite, brucite, gibbsite, or protomagnesite. In various embodiments, the secondary compound may comprise at least one of hydromagnesite, artinite, hydrotalcite, dypingite, giorgiosite, brucite, gibbsite, or protomagnesite. In various embodiments, the oxidizer may comprise at least one of sodium bromate or potassium bromate. In various embodiments, the fuel may comprise at least one of a salt of cyanuric acid, potassium hydroxyacetate, or magnesium hydroxyacetate.

In various embodiments, the obscurant-emitting composition may comprise between 45% and 90% by weight oxidizer. In various embodiments, the obscurant-emitting composition may comprise between 6% and 40% by weight fuel. In various embodiments, the hydrated salt composition may comprise between 90% and 99.9% by weight primary compound. In various embodiments, the hydrated salt composition may comprise between 0.1% and 10% by weight secondary compound.

In various embodiments, an obscurant-emitting system may comprise a vessel; an obscurant-emitting composition comprised within the vessel comprising an oxidizer, a fuel, and a hydrated salt composition, wherein, the obscurant-emitting composition comprises between 0.001% and 8% by weight hydrated salt composition. In various embodiments, the obscurant-emitting system may further comprise an ignition device configured to ignite the obscurant-emitting composition.

In various embodiments, the hydrated salt composition may comprise a primary compound and a secondary compound, wherein the primary compound comprises at least one of hydromagnesite, artinite, hydrotalcite, dypingite, giorgiosite, brucite, gibbsite, or protomagnesite. In various embodiments, the secondary compound may comprise at least one of hydromagnesite, artinite, hydrotalcite, dypingite, giorgiosite, brucite, gibbsite, or protomagnesite. In various embodiments, the oxidizer may comprise at least one of sodium bromate or potassium bromate. In various embodiments, the fuel may comprise at least one of a salt of cyanuric acid, potassium hydroxyacetate, or magnesium hydroxyacetate. In various embodiments, the obscurant-emitting composition may comprise between 45% and 90% by weight oxidizer. In various embodiments, the obscurant-emitting composition may comprise between 6% and 40% by weight fuel. In various embodiments, the hydrated salt composition may comprise between 90% and 99.9% by weight primary compound, and the hydrated salt composition may comprise between 0.1% and 10% by weight secondary compound.

In various embodiments, a method of making an obscurant-emitting system may comprise forming an obscurant-emitting composition by combining an oxidizer, a fuel, and a hydrated salt composition, wherein the hydrated salt composition may comprise a primary compound and a secondary compound, wherein the obscurant-emitting composition may comprise between 0.001% and 8% by weight hydrated salt composition. In various embodiments, the method may further comprise disposing the oxidizer, the fuel, and the hydrated salt composition in a vessel, wherein the mixing occurs at least one of before, during, or after the disposing.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures. In the figures, like referenced numerals may refer to like parts throughout the different figures unless otherwise specified.

DETAILED DESCRIPTION

All ranges may include the upper and lower values, and all ranges and ratio limits disclosed herein may be combined. It is to be understood that unless specifically stated otherwise, references to "a," "an," and/or "the" may include one or more than one and that reference to an item in the singular may also include the item in the plural.

The detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that logical, chemical, and mechanical changes may be made without departing from the scope of the disclosure. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected, or the like may include permanent, removable, temporary, partial, full, and/or any other possible attachment option. Additionally, any reference to without contact (or similar phrases) may also include reduced contact or minimal contact.

Figure 1:
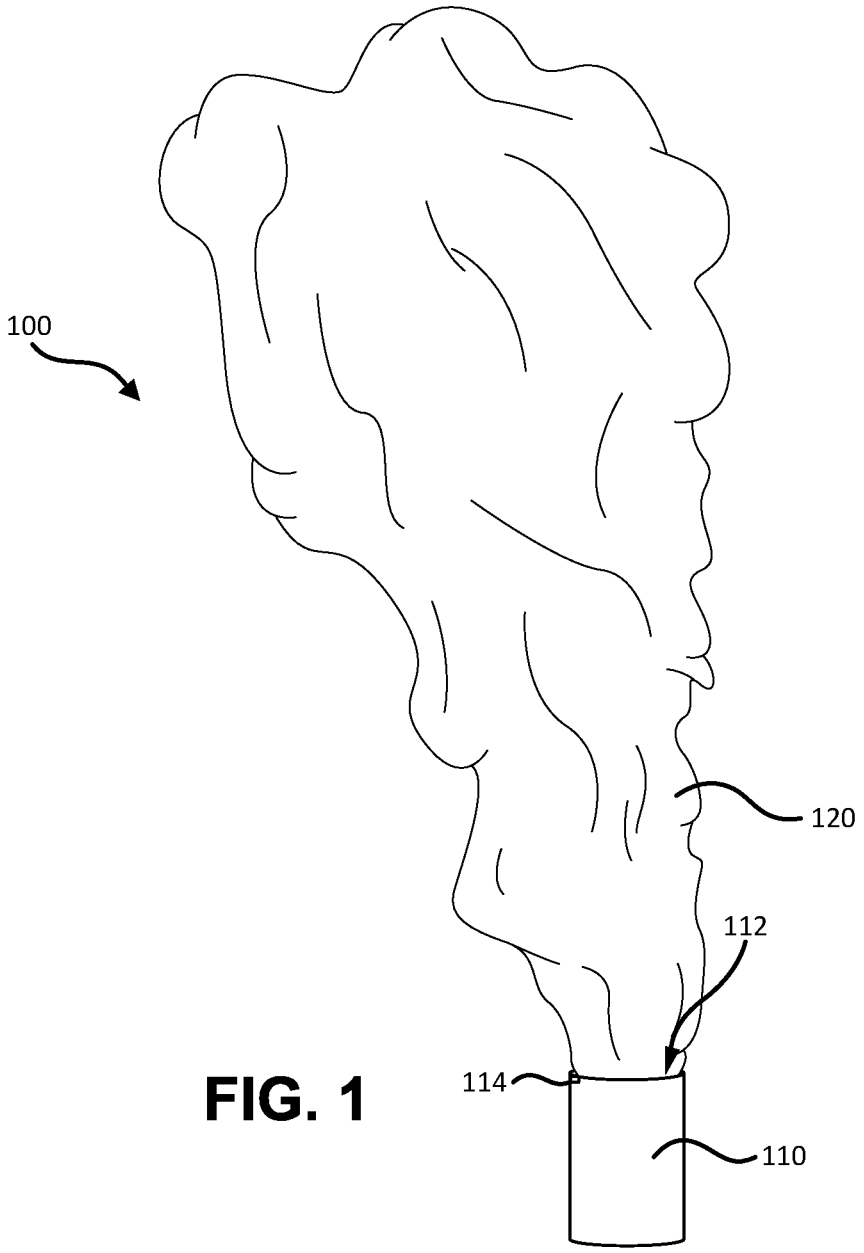
FIG. 1 illustrates an obscurant-emitting system, in accordance with various embodiments.

In various embodiments, with reference to FIG. 1, an obscurant-emitting system 100 may comprise a vessel 110 with a vessel interior 112. An obscurant-emitting composition may be disposed in vessel interior 112. Vessel 110 may also comprise an ignition device 114 such as a primer, an electronic match, a hot filament, and/or the like. In operation, ignition device 114 may be actuated, and ignition device 114 may cause ignition of the obscurant-emitting composition. The obscurant-emitting composition may burn and emit an obscurant cloud 120 (e.g., a smoke, particulate, and/or vapor cloud) configured to absorb, scatter, or reflect electromagnetic radiation (e.g., visible light, infrared radiation, or any other frequency on the electromagnetic spectrum) in order to obscure vision, or other communication, into the area occupied by obscurant cloud 120. Obscurant cloud 120 may be emitted through any suitable portion of vessel 110. Obscurant cloud 120 may absorb, scatter, or reflect electromagnetic radiation such that the obscurant in obscurant cloud 120 may prevent, or partially prevent, electromagnetic radiation from passing through obscurant cloud 120.

In various embodiments, an obscurant-emitting composition may comprise an oxidizer, a fuel, and a hydrated salt composition. In various embodiments, the oxidizer may comprise a compound comprising a cation and an anion. The cation of the oxidizer may be the ionic form of an alkali metal and/or an alkali-earth metal. For example, the cation of the oxidizer may be a sodium, lithium, or potassium cation. The anion of the oxidizer may comprise nitrate, chlorate, bromate, iodate, perchlorate, periodates, and/or chlorite. In various embodiments, the oxidizer may comprise lithium nitrate, sodium nitrate, potassium nitrate, aluminum nitrate, lithium chlorate, sodium chlorate, potassium chlorate, lithium bromate, sodium bromate, potassium bromate, lithium iodate, sodium iodate, potassium iodate, aluminum iodate, ammonium iodate, lithium perchlorate, sodium perchlorate, potassium perchlorate, aluminum perchlorate, lithium periodate, sodium periodate, potassium periodate, aluminum periodate, lithium chlorite, sodium chlorite, potassium chlorite, aluminum chlorite, lithium bromite, sodium bromite, or mixtures thereof.

In various embodiments in which the oxidizer comprises potassium bromate ($KBrO_3$), in operation, the oxidizer ($KBrO_3$) decomposes directly into the obscurant, potassium bromide (KBr), in response to burning, the reaction for which is shown in Equation 1:

$$2KBrO_3 \rightarrow 2KBr + 3O_2 \qquad \text{Equation 1}$$

Because the potassium bromate decomposes directly into the obscurant, potassium bromide, the potassium bromate decomposition provides efficient obscurant production. Additionally, in various embodiments, potassium bromide decomposition may exhibit a 100% yield of potassium bromide, further demonstrating the efficiency of obscurant production. Further, the density of potassium bromate, which is 3.27 grams per cubic centimeter, allows efficient packing of the oxidizer into a vessel, such as vessel 110 in FIG. 1, thereby allowing a single vessel to produce greater amounts of obscurant than a vessel comprising a less-dense oxidizer.

An obscurant-emitting composition may comprise one or more species of oxidizers as described herein. In various embodiments, the obscurant-emitting composition may comprise 45% to 90% by weight oxidizer. In various embodiments, the obscurant-emitting composition may comprise 60% to 80% by weight oxidizer. In various embodiments, the obscurant-emitting composition may comprise 65% to 75% by weight oxidizer. In various embodiments, the obscurant-emitting composition may comprise 65% to 72% by weight oxidizer.

In various embodiments, the fuel of the obscurant-emitting composition may comprise a salt of cyanuric acid, such as lithium cyanurate, sodium cyanurate, potassium cyanurate, magnesium cyanurate, lithium isocyanurate, sodium cyanurate, potassium isocyanurate, magnesium isocyanurate, or other organic salts, such as lithium barbiturate, sodium barbiturate, potassium barbiturate, magnesium barbiturate, lithium hydroxyacetate, sodium hydroxyacetate, potassium hydroxyacetate, magnesium hydroxyacetate, lithium tartrate, sodium tartrate, potassium tartrate, magnesium tartrate, or mixtures thereof.

In various embodiments, in which potassium cyanurate is the fuel of the obscurant-emitting composition, the potassium cyanurate may contribute to the potassium bromide decomposition giving a 100% yield of potassium bromide. Potassium cyanurate decomposes at about the same temperature as potassium bromate, causing a complete decomposition of the oxidizer and fuel. Additionally, the complete decomposition of the oxidizer and fuel minimizes, if not eliminates, the production of inorganic residue which may obstruct the exit of the obscurant and other decomposition reaction products from the vessel in which they are housed. Further, the decomposition of potassium cyanurate is an endothermic reaction, helping the decomposition reaction proceed with a lower flame temperature than with other fuels. A lower flame temperature helps avoid an undesired fire being caused by the ignition and burning of the obscurant-emitting composition.

In various embodiments, the oxidizer may be present in a greater amount than the fuel in the obscurant-emitting composition. Accordingly, the weight ratio of oxidizer to fuel can be greater than about 1:1, allowing for a cleaner burning composition. In various embodiments, the weight ratio of oxidizer to fuel is from about 3:2 to about 5:1. In various embodiments, the weight ratio of oxidizer to fuel is from about 4:1 to about 10:1. In various embodiments, the obscurant-emitting composition may comprise 6% and 40% by weight fuel. In various embodiments, the obscurant-emitting composition may comprise 20% and 35% by weight fuel. In various embodiments, the obscurant-emitting composition may comprise 25% and 30% by weight fuel.

In various embodiments, the hydrated salt composition of the obscurant-emitting composition may comprise one or more different compounds (e.g., hydrated salts and/or salt hydroxides) and, in various embodiments, two or more different compounds. In various embodiments, the hydrated salt composition may comprise a primary compound and a secondary compound. In various embodiments, the primary compound may be hydromagnesite ($MgCO_3.Mg(OH)_2.4H_2O$), artinite ($Mg_2(CO_3)(OH)_2.3H_2O$), hydrotalcite $Mg_6Al_2CO_3(OH)_{16}.4(H_2O)$, dypingite ($MgCO_3.Mg(OH)_2.5H_2O$), giorgiosite $Mg_5(CO_3)_4(OH)_2.5(H_2O)$, brucite ($Mg(OH)_2$), gibbsite ($Al(OH)_3$), and/or protomagnesite ($Mg_5(CO_3)_4(OH)_2.11H_2O$). In various embodiments, the secondary compound may be hydromagnesite, artinite, hydrotalcite, dypingite, giorgiosite, and/or protomagnesite.

In various embodiments, the hydrated salt composition may be chosen to absorb thermal energy of the obscurant-emitting composition combustion reaction, throughout the range of combustion temperatures, such as between 200° C. (392° C.) to 500° C. (932° F.). The hydrated salt composition may absorb energy of the combustion reaction by releasing vaporized water molecules through dehydration of hydrated salts and/or metal hydroxides, and release carbon dioxide through further mineral decomposition. Such release of water and carbon dioxide molecules may help modulate the temperature of the combustion reaction of the obscurant-emitting composition creating the obscurant.

In various embodiments, the primary compound in the hydrated salt composition may be hydromagnesite, which releases water molecules at temperatures up to 300° C. (572° F.). Therefore, in response to the flame temperature of the combustion of the obscurant-emitting composition reaching temperatures up to 300° C. (572° F.), the decomposition of hydromagnesite may release water molecules to cool the flame temperature. Additionally, hydromagnesite continues to absorb heat of the obscurant-emitting composition combustion reaction up to 560° C. (1040° F.), with the further emission of carbon dioxide gas. Therefore, up to 560° C. (1040° F.), hydromagnesite may function to modulate the combustion reaction temperature of the obscurant-emitting composition.

The releasing water of water molecules may be a more effective cooling method than the release of carbon dioxide gas. Therefore, it may be beneficial to have a secondary compound which releases water molecules at a temperature higher than 300° C. (572° F.). In various embodiments, for example, the secondary compound of the hydrated salt composition may comprise dypingite, which releases water molecules at temperatures up to about 380° C. (716° F.). Therefore, in response to the obscurant-emitting composition combustion reaction reaching temperatures over 300° C. (572° F.), dypingite may provide the release of water molecules in addition to those released by the primary compound (e.g., hydromagnesite) and already released by dypingite. Additionally, dypingite releases carbon dioxide at temperatures up to about 570° C. (1058° F.) to provide further cooling.

The hydrated salt composition, with the primary and secondary compounds, provides a tiered cooling of the obscurant-emitting composition combustion reaction as it reaches higher and higher temperatures. Therefore, the hydrated salt composition absorbs heat and releases cooling agents (i.e., water and/or carbon dioxide molecules) in response to the obscurant-emitting composition combustion reaction reaching temperatures requiring cooling. The modulated cooling by the hydrated salt composition also allows the obscurant-emitting composition to be effective at combusting and producing the obscurant independent of ambient humidity. In addition, the products of the combustion reaction of the obscurant-emitting composition (water vapor, oxygen gas, and carbon dioxide gas, specifically) not only help cool the reaction, but they also help disperse and aerosolize the obscurant into the air to form the desired obscurant cloud (such as obscurant cloud 120 in FIG. 1).

In various embodiments, the obscurant-emitting composition may comprise 0.001% to 8% by weight hydrated salt composition. In various embodiments, the obscurant-emitting composition may comprise 1% to 7% by weight hydrated salt composition. In various embodiments, the obscurant-emitting composition may comprise 2% to 6% by weight hydrated salt composition. In various embodiments, the obscurant-emitting composition may comprise 3% to 4% by weight hydrated salt composition. More than 10% by weight of the hydrated salt composition in the obscurant-emitting composition may result in a less efficient combustion reaction of the obscurant-emitting composition because of the release of too many water molecules from the hydrated salts, which may result in drowning out the flame of the reaction. Additionally, with less hydrated salt composition, the obscurant-emitting composition may comprise more oxidizer to produce more obscurant. In various embodiments, the hydrated salt composition may comprise between 90% and 100% by weight primary compound. In various embodiments, the hydrated salt composition may comprise between 90% and 99.9% by weight primary compound. In various embodiments, the hydrated salt composition may comprise between 93% and 98% by weight primary compound. In various embodiments, the hydrated salt composition may comprise between 94% and 96% by weight primary compound. In various embodiments, the hydrated salt composition may comprise between 0% and 10% by weight secondary compound. In various embodiments, the hydrated salt composition may comprise between 0.1% and 10% by weight secondary compound. In various embodiments, the hydrated salt composition may comprise between 2% and 8% by weight secondary compound. In various embodiments, the hydrated salt composition may comprise between 4% and 6% by weight secondary compound.

In various embodiments, additional materials, such as multispectral materials, may be added to the hydrated salt composition and/or obscurant-emitting composition as a whole. Multispectral materials may allow an obscurant-emitting composition to have multi-spectral use. For example, if an obscurant of infrared radiation is desired, the hydrated salt composition and/or obscurant-emitting composition may further comprise brass, aluminum, and/or copper flakes, graphite, graphene, carbon black, mica, and/or any other suitable multispectral. In various embodiments, the obscurant-emitting composition may comprise between 0% and 25% by weight, or between 5% to 15% by weight, multispectral material. The combustion of an obscurant-emitting composition comprising such multispectral materials may produce an obscurant cloud capable of absorbing infrared radiation.

In various embodiments, exemplary particle sizes for the oxidizer (e.g., $KBrO_3$) and fuel (e.g., potassium cyanurate) may range from 1 μm ($3.9e^{-5}$ inch) to 100 μm (0.0039 inch), from 1 ($3.9e^{-5}$ inch) μm to 50 μm (0.0020 inch), or from 1 ($3.9e^{-5}$ inch) μm to 30 μm (0.0012 inch). In various embodiments, exemplary particle sizes for the hydrated salts (e.g. hydromagnesite and dypingite) may be less than 100 μm (0.0039 inch), less than 40 μm (0.0016 inch), or less than 10 μm (0.00039 inch).

In various embodiments, the obscurant-emitting composition may comprise a binder, such as a polymeric material or plasticizer. The binder may be used to aggregate the particles of the oxidizer, fuel, and/or hydrated salt composition to form desired shapes or orientations (i.e., pellets, stars, chips, etc.), which may allow more efficient packing into a vessel and/or more efficient combustion of the obscurant-emitting composition. In various embodiments, the obscurant-emitting composition may comprise between 0.2% and 10% by weight binder.

The obscurant-emitting composition has been shown to effectively perform (i.e., combust and emit the obscurant) in a broad temperature range of −40° C. (−40° F.) to 71° C.

(160° F.) because, among other things, of the temperature modulation of the combustion reaction by the hydrated salt composition. Additionally, the obscurant, potassium bromide, has been shown to be an effective flame retardant, giving the obscurant-emitting composition a further use as a fire suppressant. Such use as a fire suppressant, in embodiments in which the obscurant-emitting composition comprises a material which should not be combusted, such as various multispectral materials, may mitigate or eliminate the undesirable combustion of such materials.

The effectiveness of an obscurant in the field is measured by a number of factors: the absorption of light in a medium (i.e., how well vision of an area is obscured by the obscurant), the density at which the material may be packed, and how well the material may be disseminated. The unit figure of merit (FOM) may be used to show the field performance effectiveness of an obscurant-emitting system, such as a gas grenade. The FOM is given by $FOM=\alpha\rho FY$, wherein $\alpha$ is the extinction coefficient in square meters per gram, which shows the ability of the obscurant to absorb light (i.e., if the cloud of emitted obscurant is opaque, it will have a higher extinction coefficient); $\rho$ is the density of the obscurant material; F is the fill factor, which is the ratio of packed density to the intrinsic material density; and yield is the ratio of airborne mass to initial mass of material in the vessel (e.g., a gas grenade). In accordance with various embodiments, with an obscurant-emitting composition comprising 65% to 72% by weight potassium bromate oxidizer, 25% to 30% by weight potassium cyanurate fuel, and 3% to 4% by weight hydrated salt composition comprising hydromagnesite as the primary compound and dypingite as the secondary compound, the obscurant-emitting composition gave an FOM of between 3 and 3.5, which is independent of ambient humidity and releases very little, if any, toxic compounds. Such an FOM is better than other preexisting obscurant-emitting compositions having the advantages of the obscurant-emitting composition described herein.

Figure 2:
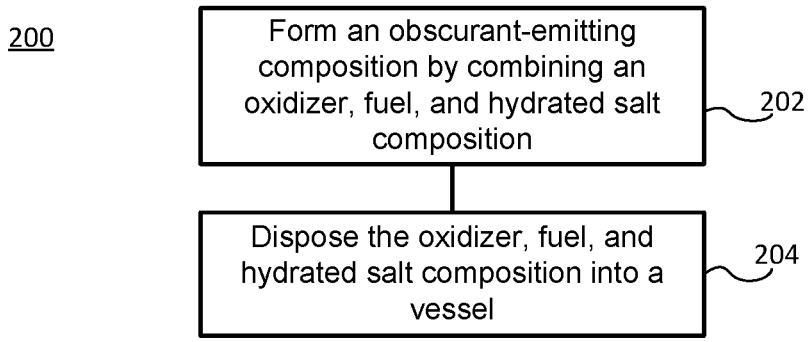
FIG. 2 illustrates a method for making an obscurant-emitting system, in accordance with various embodiments.

In various embodiments, with reference to FIG. 2, a method 200 for making an obscurant-emitting system is depicted. In various embodiments, an obscurant-emitting composition may be formed by combining an oxidizer, a fuel, and a hydrated salt composition (step 202). The components of the hydrated salt composition may be any of the compounds discussed herein, and in any of the amounts discussed herein. In various embodiments, the oxidizer, fuel, and hydrated salt composition may be disposed into a vessel (step 204), such as a gas grenade. The oxidizer, fuel, and hydrated salt composition (including the mixing of the primary compound and the secondary compound) may be mixed before, during, or after being disposed into the vessel.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is intended to invoke 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. An obscurant-emitting composition, comprising:

an oxidizer comprising a cation comprising at least one of an alkali metal or an alkaline earth metal, and an anion comprising at least one of nitrate, chlorate, bromate, iodate, perchlorate, periodate, or chlorite;

a fuel; and a hydrated salt composition, wherein the obscurant-emitting composition comprises between 3% and 4% by weight the hydrated salt composition, wherein the hydrated salt composition comprises a primary compound comprising hydromagnesite and a secondary compound, and wherein the hydrated salt composition comprises between 90% and 99.9% by weight hydromagnesite and between 0.1% and 10% by weight the secondary compound.

2. The obscurant-emitting composition of claim 1, wherein the secondary compound comprises at least one of hydromagnesite, artinite, hydrotalcite, dypingite, giorgiosite, brucite, gibbsite, or protomagnesite.

3. The obscurant-emitting composition of claim 2, wherein the secondary compound comprises dypingite.

4. The obscurant-emitting composition of claim 3, wherein the oxidizer comprises at least one of sodium bromate or potassium bromate.

5. The obscurant-emitting composition of claim 4, wherein the fuel comprises at least one of a salt of cyanuric acid, potassium hydroxyacetate, or magnesium hydroxyacetate.

6. The obscurant-emitting composition of claim 5, comprising between 45% and 90% by weight the oxidizer.

7. The obscurant-emitting composition of claim 6, comprising between 6% and 40% by weight the fuel.

* * * * *